US012018437B2

(12) United States Patent
Kambara et al.

(10) Patent No.: US 12,018,437 B2
(45) **Date of Patent: *Jun. 25, 2024**

(54) PAPERMAKING AGENT, MANUFACTURING METHOD FOR PAPERMAKING AGENT AND PAPER

(71) Applicant: ARAKAWA CHEMICAL INDUSTRIES, LTD., Osaka (JP)

(72) Inventors: Ryusuke Kambara, Osaka (JP); Hiroyuki Ioka, Osaka (JP); Shuichi Takaki, Osaka (JP)

(73) Assignee: ARAKAWA CHEMICAL INDUSTRIES, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/946,041

(22) Filed: Sep. 16, 2022

(65) Prior Publication Data

US 2023/0203756 A1 Jun. 29, 2023

(30) Foreign Application Priority Data

Sep. 17, 2021 (JP) ..... 2021-152559

(51) Int. Cl.

| | |
|---|---|
| ***D21H 21/18*** | (2006.01) |
| ***D21H 17/29*** | (2006.01) |
| ***D21H 17/37*** | (2006.01) |
| ***D21H 17/38*** | (2006.01) |

(52) U.S. Cl.

CPC ..... *D21H 21/18* (2013.01); *D21H 17/29* (2013.01); *D21H 17/375* (2013.01); *D21H 17/38* (2013.01)

(58) Field of Classification Search

CPC ..... D21H 21/18; D21H 17/29; D21H 17/375; D21H 17/38

USPC ..... 162/164.6

See application file for complete search history.

(56) References Cited

U.S. PATENT DOCUMENTS

2023/0085796 A1* 3/2023 Kambara ..... D21H 17/375 162/164.6

FOREIGN PATENT DOCUMENTS

| | | |
|---|---|---|
| JP | S63219696 | 9/1988 |
| JP | 2011168948 | 9/2011 |
| JP | 2012251252 | 12/2012 |

OTHER PUBLICATIONS

JP 2018-012909, Satoru et al., machine translation, Jan. 2012.*

* cited by examiner

*Primary Examiner* — Dennis R Cordray
(74) *Attorney, Agent, or Firm* — JCIPRNET

(57) ABSTRACT

A papermaking agent exhibiting an excellent freeness and paper strength effect with little increase in viscosity after long-term storage. A papermaking agent including a (meth) acrylamide polymer containing two or more starches (a1) selected from the group consisting of unmodified starch, oxidized starch, esterified starch, etherified starch, amidated starch, cationic starch, amphoteric starch and crosslinked starch, a (meth)acrylamide (a2), a polymerizable monomer having an amino group (a3), a polymerizable monomer having a carboxy group (a4) and a polymerizable monomer having a sulfonate group (a5) as essential constituent components.

10 Claims, 1 Drawing Sheet

PAPERMAKING AGENT, MANUFACTURING METHOD FOR PAPERMAKING AGENT AND PAPER

CROSS-REFERENCE TO RELATED APPLICATION

This application claims the priority benefit of Japan application serial no. 2021-152559, filed on Sep. 17, 2021. The entirety of the above-mentioned patent application is hereby incorporated by reference herein and made a part of this specification.

BACKGROUND

Technical Field

The present invention relates to a papermaking agent, a manufacturing method for a papermaking agent and paper.

Description of Related Art

Papermaking agents are chemicals that are added to a pulp slurry during papermaking, and mainly used for improving the strength and freeness of paper and the yield of additive chemicals and fine fibers.

Particularly, conventionally, (meth)acrylamide polymers (Patent Documents 1 and 2) and starch are mainly used as papermaking agents for increasing the strength of paper. (Meth)acrylamide polymers have high fixability to pulp, and exhibit an excellent paper strength effect even when added in a small amount but are more expensive than starch. On the other hand, starch is an inexpensive and biodegradable (biomass) material, but has low fixability to pulp. In order to exhibit a strong paper strength effect similar to that of (meth)acrylamide polymers, it is necessary to add a large amount of starch to the pulp non-volatile content.

Thus, by taking advantage of a (meth)acrylamide polymer and starch, these materials have been developed for a method of obtaining a papermaking agent that is relatively inexpensive and has an excellent paper strength effect.

As specific examples thereof, papermaking agents obtained by graft polymerization of a monomer mixture including only specified amounts of dialkylaminoalkyl (meth)acrylamide, (meth)acrylic acid and (meth)acrylamide to starch or modified starch are known (Patent Document 3). However, the polymer obtained by such a polymerization method has a quality problem that the viscosity tends to increase (poor storage stability) due to starch aging over time.

PATENT DOCUMENTS

[Patent Document 1] Japanese Patent Laid-Open No. 2012-251252

[Patent Document 2] Japanese Patent Laid-Open No. 2011-168948

[Patent Document 3] Japanese Patent Laid-Open No. S63-219696

SUMMARY

The present invention provides a papermaking agent exhibiting an excellent freeness and paper strength effect with little increase in viscosity after long-term storage.

The inventors conducted extensive studies regarding use of two or more different starches in combination and appropriate adjusting of a monomer composition, and completed the present invention. Specifically, the present invention relates to the following papermaking agent, manufacturing method for a papermaking agent and paper.

1. A papermaking agent including a (meth)acrylamide polymer containing two or more starches (a1) selected from the group consisting of unmodified starch, oxidized starch, esterified starch, etherified starch, amidated starch, cationic starch, amphoteric starch and crosslinked starch, a (meth) acrylamide (a2), a polymerizable monomer having an amino group (a3), a polymerizable monomer having a carboxy group (a4) and a polymerizable monomer having a sulfonate group (a5) as essential constituent components.

2. The papermaking agent according to the above 1,
wherein the component (a1) includes one type of starches (a1-1) selected from the group consisting of esterified starch and amphoteric starch and one type of starches (a1-2) selected from the group consisting of unmodified starch, oxidized starch and cationic starch.

3. The papermaking agent according to the above 1 or 2,
wherein the ratio between the amount of the component (a1) used in terms of non-volatile content weight and a total amount of the components (a2) to (a5) used is $[(a1)/\{(a2)+(a3)+(a4)+(a5)\}]=5/95$ to $45/55$.

4. The papermaking agent according to any one of the above 1 to 3,
wherein, when the total amount of the components (a2) to (a5) used is set as 100 weight %, the amount of the component (a3) is 1.5 to 35 weight %, the amount of the component (a4) is 1 to 15 weight %, and the amount of the component (a5) is 0.5 to 8 weight %.

5. The papermaking agent according to any one of the above 1 to 4,
wherein the constituent component further includes a polymerizable monomer having a crosslinkable group (a6).

6. The papermaking agent according to any one of the above 1 to 5,
wherein the weight average molecular weight of the (meth)acrylamide polymer is 1,500,000 to 7,000,000.

7. The papermaking agent according to any one of the above 1 to 6,
wherein the maximum value of the turbidity of an aqueous solution containing 1 weight % of the (meth) acrylamide polymer at a pH of 3 to 9 diluted with water prepared from deionized water and sodium sulfate and having an electrical conductivity of 3 mS/cm at 25° C. is 50 to 1,000 NTU.

8. A method for manufacturing the papermaking agent according to any one of the above 1 to 7, including a process of obtaining a (meth)acrylamide polymer by polymerizing a component (a1), a component (a2), a component (a3), a component (a4) and a component (a5) as essential constituent components in the presence of the component (a1).

9. The method for manufacturing the papermaking agent according to the above 8, wherein the constituent component further includes a polymerizable monomer having a crosslinkable group (a6).

10. Paper including the papermaking agent according to any one of the above 1 to 7.

According to the papermaking agent of the present invention, the increase in viscosity during long-term storage is small and an excellent freeness and paper strength effect is exhibited.

DESCRIPTION OF THE EMBODIMENTS

Figure 1:
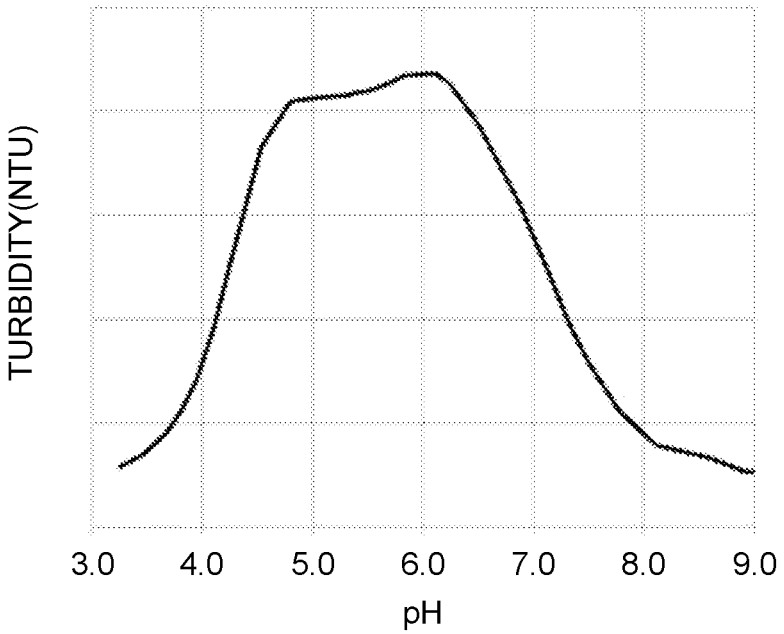
FIG. 1 is a diagram showing a case in which there is "one peak" in the pH-turbidity distribution.

A papermaking agent of the present invention contains a (meth)acrylamide polymer including two or more starches (a1) selected from the group consisting of unmodified starch, oxidized starch, esterified starch, etherified starch, amidated starch, cationic starch, amphoteric starch and crosslinked starch (hereinafter referred to as a component (a1)), a (meth)acrylamide (a2) (hereinafter referred to as a component (a2)), a polymerizable monomer having an amino group (a3) (hereinafter referred to as a component (a3)), a polymerizable monomer having a carboxy group (a4) (hereinafter referred to as a component (a4)) and a polymerizable monomer having a sulfonate group (a5) (hereinafter referred to as a component (a5)) as essential constituent components.

The component (a1) is two or more starches selected from the group consisting of unmodified starch, oxidized starch, esterified starch, etherified starch, amidated starch, cationic starch, amphoteric starch and crosslinked starch. When two or more selected from among the above group are used as the component (a1), the obtained papermaking agent exhibits excellent storage stability, and when the obtained papermaking agent is added to a pulp slurry, the pulp is appropriately aggregated due to the (meth)acrylamide polymer contained in the agent and an excellent paper strength effect is exhibited.

Examples of unmodified starches include corn starch, waxy corn starch, potato starch, tapioca starch, wheat starch, rice starch, and sago starch.

Examples of oxidized starches include those obtained by treating the unmodified starch with an oxidizing agent.

Examples of oxidizing agents include halogens such as chlorine, bromine, hypochlorite, and hypobromite. In addition, examples of salts include alkali metal salts such as potassium and sodium.

Examples of esterified starches include inorganic acid-esterified starches such as nitrate esterified starch, sulfate esterified starch, phosphate-esterified starch, and urea-phosphate-esterified starch; and organic acid-esterified starches such as acetoacetate esterified starch, acetate esterified starch, xanthogen acetate esterified starch, succinate esterified starch, maleic anhydride esterified starch, and fumaric anhydride esterified starch.

Examples of etherified starches include alkyl-etherified starches such as methyl-etherified starch, ethyl-etherified starch, and propyl-etherified starch; hydroxyalkyl-etherified starches such as hydroxymethyl-etherified starch, hydroxyethyl-etherified starch, hydroxypropyl-etherified starch, and hydroxybutyl-etherified starch; carboxymethyl-etherified starch, allyl etherified starch and the like.

Examples of amidated starches include carbamoylethylated starch.

Cationic starch is obtained by treating the unmodified starch with a compound having a cationic group. Examples of compounds having a cationic group include ammonium halides such as 2-diethylaminoethylammonium chloride and 2,3-epoxypropyltrimethylammonium chloride.

Amphoteric starch is obtained by treating the unmodified starch with a compound having a cationic group and a compound having an anionic group, or a compound having both a cationic group and an anionic group, that is, it means a starch having both a cationic group and an anionic group. Here, amphoteric starches include those having a phosphate ester group and those not having such ester groups.

Examples of crosslinked starches include phosphate crosslinked starch, acetylated phosphate cross-linked starch, adipic acid cross-linked starch, acetylated adipic acid cross-linked starch, formaldehyde crosslinked starch, acrolein crosslinked starch, and epichlorohydrin crosslinked starch.

As the component (a1), degraded starches can also be used. Degraded starches are obtained by reacting unmodified starch, oxidized starch, esterified starch, etherified starch, amidated starch, cationic starch, amphoteric starch or crosslinked starch with a degrading agent and performing heating and stirring at 60 to 100° C. for 30 to 60 minutes.

Examples of degrading agents include hypochlorite, peroxodisulfates (ammonium persulfate, potassium persulfate, sodium persulfate, etc.), and inorganic peroxides such as hydrogen peroxide; bacteria, and enzymes such as α-amylase. These may be used alone or two or more thereof may be used in combination. Here, when hydrogen peroxide is used, at least one water-soluble metal salt of iron sulfate and copper sulfate may be combined.

Here, the degraded starches obtained by the above method are defined as shown in Table 1 according to the raw materials used.

TABLE 1

| Raw material used | Name of starch produced |
|---|---|
| Unmodified starch | Degraded starch |
| Oxidized starch | Degraded oxidized starch |
| Esterified starch | Degraded esterified starch |
| Etherified starch | Degraded etherified starch |
| Amidated starch | Degraded amidated starch |
| Cationic starch | Degraded Cationic starch |
| Amphoteric starch | Degraded amphoteric starch |
| Crosslinked starch | Degraded crosslinked starch |

Examples of commercial products of the component (a1) include "Cornstarch," "Ace A," "Ace P160," and "Ace K100" (commercially available from Oji Cornstarch Co., Ltd.), "Nisshoku MS #4600" (commercially available from Nihon Shokuhin Kako Co., Ltd.), "NutraStar RA-900" (commercially available from Sanwa Cornstarch Co., Ltd.), and "CS-2" (commercially available from Arakawa Chemical Industries, Ltd.). These may be used alone or two or more thereof may be used in combination.

Regarding physical properties of the component (a1), the viscosity of the gelatinization liquid of the component (a1) with a non-volatile content concentration of 20 weight % at a temperature of 25° C. is preferably 5 to 5,000 mPa·s and more preferably 10 to 2,500 mPa·s. When the component (a1) having the above viscosity is used, it is likely to react with constituent components such as (meth)acrylamide, the resulting papermaking agent exhibits excellent storage stability, the turbidity of the papermaking agent is easily improved, and when added to a pulp slurry, the pulp is appropriately aggregated due to the (meth)acrylamide polymer contained in the agent, and an excellent paper strength effect is easily exhibited. Here, the gelatinization liquid of the component (a1) with a concentration of 20 weight % is obtained by diluting the component (a1) in a solvent to be described below (particularly, water is preferable) to a concentration of 20 weight % and then performing heating and stirring at a temperature of 90° C. for 1 hour. In addition, the viscosity is a value measured by a B-type viscometer.

Among these, in order for the papermaking agent to exhibit excellent storage stability, as the component (a1), it is preferable to include one type of starches (a1-1) selected from the group consisting of esterified starch and amphoteric starch (hereinafter referred to as a component (a1-1)) and one type of starches (a1-2) selected from the group consisting of unmodified starch, oxidized starch and cationic starch (hereinafter referred to as a component (a1-2)).

In order for the papermaking agent to exhibit excellent storage stability, the ratio between the component (a1-1) and the component (a1-2) used in terms of non-volatile content weight is preferably (a1-1)/(a1-2)=5/95 to 95/5, more preferably 10/90 to 90/10, and still more preferably 20/80 to 80/20.

Here, in order for the papermaking agent to exhibit excellent storage stability, the component (a1-1) is more preferably a starch having a phosphate ester group.

Examples of such a component (a1-1) (that is, starches having a phosphate ester group) include phosphate-esterified starch (including an amphoteric starch having a phosphate ester group; the same applies hereinafter) and urea-phosphate-esterified starch. These may be used alone or two or more thereof may be used in combination. Among these, in order for the papermaking agent to exhibit excellent storage stability, an amphoteric starch having a phosphate ester group, or urea-phosphate-esterified starch is more preferable.

In addition, the component (a1-2) is preferably oxidized starch or degraded cationic starch.

Although details are unknown, the mechanism by which the papermaking agent of the present invention exhibits excellent storage stability will be described below.

It is conceivable that the increase in viscosity that occurs during long-term storage of the present invention may be caused by starch aging or exhibition of thixotropy.

Although (meth)acrylamide polymers polymerized in the presence of starches having a phosphate ester group can minimize an increase in viscosity due to starch aging, the viscosity increases over time because strong thixotropy is exhibited. On the other hand, in the (meth)acrylamide polymers polymerized in the presence of starches having no phosphate ester group, starch aging tends to occur rapidly, but thixotropy tends not to be exhibited compared to that of starches having a phosphate ester group.

Therefore, it is speculated that, when starches having a phosphate ester group and starches having no phosphate ester group are used in combination, both aging and exhibition of thixotropy, which are factors that cause an increase in viscosity, are minimized, and excellent stability is exhibited even after long-term storage. When a combination of the component having a phosphate ester group (a1-1) and the component (a1-2) is used as the component (a1), it is conceivable that this speculated mechanism is particularly likely to occur, and excellent storage stability is exhibited.

Here, the amount of three or more types of starches used (in order of the component (a1-3), the component (a1-4), . . . , component (a1-n) (n: a positive integer)) other than the component (a1-1) and the component (a1-2) with respect to 100 weight % of the total component (a1) is preferably 5 weight % or less and more preferably 3 weight % or less.

The component (a2) is methacrylamide or acrylamide. These may be used alone or two or more thereof may be used in combination.

The component (a3) is a polymerizable monomer having an amino group, and is a component that is incorporated into a (meth)acrylamide polymer and allows the polymer to fix to pulp favorably. Examples of components (a3) include polymerizable monomers having a secondary amino group, polymerizable monomers having a tertiary amino group, and quaternary salts of these polymerizable monomers.

The polymerizable monomer having a secondary amino group is not particularly limited, and examples thereof include diallylamine. The polymerizable monomer having a tertiary amino group is not particularly limited, and examples thereof include (meth)acrylates having a tertiary amino group such as N,N-dimethylaminoethyl (meth)acrylate and N,N-diethylaminoethyl (meth)acrylate; and (meth) acrylamides having a tertiary amino group such as N,N-dimethylaminopropyl (meth)acrylamide, and N,N-diethylaminopropyl (meth)acrylamide. The quaternary salt of these monomers refers to a product obtained by reacting the polymerizable monomer having a secondary amino group or polymerizable monomer having a tertiary amino group with a quaternary agent, and the quaternary salts may be inorganic acid salts such as hydrochlorides and sulfates or organic acid salts such as acetates. In addition, examples of quaternary agents include methyl chloride, benzyl chloride, dimethyl sulfate, and epichlorohydrin. These may be used alone or two or more thereof may be used in combination. Among these, it is preferable to include a (meth)acrylate having a tertiary amino group and/or a quaternary salt of the (meth)acrylate. Here, "(meth)acrylate" refers to methacrylate or acrylate (the same applies hereinafter).

The component (a4) is a polymerizable monomer having a carboxy group and is a component that is incorporated into a (meth)acrylamide polymer, interacts with aluminum sulfate or the like added to a papermaking system, and allows the polymer to fix to pulp. Examples of components (a4) include (meth)acrylic acid, acrylic anhydride, itaconic acid, itaconic anhydride, fumaric acid, maleic acid, and maleic anhydride. Here, these components (a4) may be used as salts such as alkali metal salts such as sodium and potassium, or ammonium salts. These may be used alone or two or more thereof may be used in combination. Among these, it is preferable to include (meth)acrylic acid, itaconic acid, or itaconic anhydride.

The component (a5) is a polymerizable monomer having a sulfonate group. Examples of components (a5) include vinylsulfonic acid and methallylsulfonic acid. Here, these components (a5) may be used as salts such as alkali metal salts such as sodium and potassium, or ammonium salts. These may be used alone or two or more thereof may be used in combination. Among these, it is preferable to include methallylsulfonic acid or its alkali metal salt.

Regarding the amounts of the components (a1) to (a5) used, the ratio between the amount of the component (a1) used in terms of non-volatile content weight and a total amount of the components (a2) to (a5) used is preferably [(a1)/{(a2)+(a3)+(a4)+(a5)}]=5/95 to 45/55. With this ratio, when the papermaking agent is added to a pulp slurry, the pulp is appropriately aggregated due to the (meth)acrylamide polymer contained in the agent, the polymer is fixed to pulp fibers, and an excellent paper strength effect is exhibited. In addition, from the same point of view, the ratio is preferably [(a1)/{(a2)+(a3)+(a4)+(a5)}]=5/95 to 40/60 and more preferably [(a1)/{(a2)+(a3)+(a4)+(a5)}]=7.5/92.5 to 35/65.

When the components (a2) to (a5) are used as constituent components, respective weight proportions with respect to 100 weight % of a total amount of the components (a2) to (a5) are as follows.

Component (a2): the proportion is generally 42 to 97 weight %, and preferably 54 to 94.9 weight %

Component (a3): the proportion is generally 1.5 to 35 weight %, and preferably 3 to 30 weight %

Component (a4): the proportion is generally 1 to 15 weight %, and preferably 1.5 to 10 weight %

Component (a5): the proportion is generally 0.5 to 8 weight %, and preferably 0.6 to 6 weight %

In addition, the constituent components may further include a polymerizable monomer having a crosslinkable group (a6). Examples of components (a6) include N-alkyl (meth)acrylamides such as N-methyl(meth)acrylamide, N-ethyl(meth)acrylamide, and N-isopropyl(meth)acrylamide, N-t-butyl(meth)acrylamide; N,N-dialkyl(meth)acrylamides such as N,N-dimethyl(meth)acrylamide, N,N-diethyl (meth)acrylamide, and N,N-diisopropyl(meth)acrylamide; N,N'-alkylenebis(meth)acrylamides such as N,N'-methylenebis(meth)acrylamide, and N,N'-ethylenebis(meth)acrylamide; crosslinkable monomers having a triallyl group such as triallyl isocyanurate, triallyl trimellitate, triallylamine, and triallyl(meth)acrylamide; and triazines having a (meth)acryloyl group such as 1,3,5-triacryloyl-1,3,5-triazine, and 1,3,5-triacryloylhexahydro-1,3,5-triazine. These may be used alone or two or more thereof may be used in combination. Among these, it is preferable to include N,N-dimethyl(meth) acrylamide, N,N'-methylenebis(meth)acrylamide, or 1,3,5-triacryloylhexahydro-1,3,5-triazine.

Regarding the amounts of the components (a1) to (a6) used when the component (a6) is used as the constituent component, the ratio between the amount of the component (a1) used in terms of non-volatile content weight and a total amount of the components (a2) to (a6) used is generally [(a1)/{(a2)+(a3)+(a4)+(a5)+(a6)}]=5/95 to 45/55, preferably [(a1)/{(a2)+(a3)+(a4)+(a5)+(a6)}]=5/95 to 40/60, and more preferably [(a1)/{(a2)+(a3)+(a4)+(a5)+(a6)}]=7.5/92.5 to 35/65.

The content of the component (a6) with respect to 100 weight % of a total amount of the components (a2) to (a6) is 3 weight % or less, and preferably 2 weight % or less.

The constituent components may further include a monomer (a7) (hereinafter referred to as a component (a7)) other than the components (a2) to (a6). The component (a7) is not particularly limited, and examples thereof include polymerizable monomers having an aromatic ring such as styrene, α-methylstyrene, and vinyl toluene; alkyl(meth)acrylates such as methyl(meth)acrylate, ethyl(meth)acrylate, n-propyl (meth)acrylate, n-butyl(meth)acrylate, 2-ethylhexyl(meth) acrylate, and cyclohexyl(meth)acrylate; vinyl carboxylates such as vinyl acetate and vinyl propionate; nitriles such as acrylonitrile; mercaptans such as 2-mercaptoethanol and n-dodecyl mercaptan; alcohols such as ethanol, isopropyl alcohol, and n-pentyl alcohol; aromatic compounds such as α-methylstyrene dimer, ethylbenzene, isopropylbenzene, and cumene; and carbon tetrachloride. These may be used alone or two or more thereof may be used in combination. In addition, the content of the component (a7) with respect to 100 weight % of a total amount of the components (a2) to (a7) is less than 2 weight %.

In manufacture of (meth)acrylamide polymers, organic acids such as citric acid, succinic acid, and oxalic acid; inorganic acids such as hydrochloric acid, sulfuric acid, and phosphoric acid; inorganic bases such as sodium hydroxide, potassium hydroxide, and calcium hydroxide; and agents such as an antifoaming agent, an antioxidant, a preservative, and an antimicrobial agent may be added. These may be used alone or two or more thereof may be used in combination, and the content thereof with respect to 100 parts by weight of all constituent components is preferably 10 parts by weight or less and more preferably 8 parts by weight or less.

When the amounts of the components (a1) to (a6) used are appropriately adjusted, the (meth)acrylamide polymer of the present invention can have a high weight average molecular weight and turbidity.

The (meth)acrylamide polymer is obtained by polymerizing the component (a1), the component (a2), the component (a3), the component (a4) and the component (a5) as essential components, and as necessary, the component (a6), the component (a7) and the agent in a solvent in the presence of a polymerization initiator. For example, the manufacturing method includes a process of obtaining a (meth)acrylamide polymer by polymerizing a component (a1), a component (a2), a component (a3), a component (a4) and a component (a5) as essential constituent components in the presence of the component (a1). Here, as the component (a1), a liquid dispersed in a solvent to be described below or a component obtained by heating and gelatinizing a liquid can be used.

Examples of the above polymerization methods include a method using a dropping polymerization method, a method using a simultaneous polymerization method (putting mixed monomer solutions together), and a method combining a simultaneous polymerization method and a dropping polymerization method.

Examples of solvents include water and an organic solvent, and these may be used alone or two or more thereof may be used in combination. Examples of organic solvents include alcohols such as methanol, ethanol, n-propyl alcohol, isopropyl alcohol, n-butyl alcohol, sec-butyl alcohol, t-butyl alcohol, isobutyl alcohol, n-hexyl alcohol, n-octyl alcohol, ethylene glycol, propylene glycol, diethylene glycol, triethylene glycol, and diacetone alcohol; and ethers such as ethylene glycol monobutyl ether, propylene glycol monomethyl ether, and propylene glycol monoethyl ether.

Examples of polymerization initiators include persulfates such as ammonium persulfate, potassium persulfate, and sodium persulfate; azo compounds such as 2,2'-azobis(2-amidinopropane)hydrochloride, and 2,2'-azobis[2(2-imidazolin-2-yl)propane]hydrochloride; and hydrogen peroxide. These may be used alone or two or more thereof may be used in combination. Among these, in order for solution polymerization to proceed sufficiently, ammonium persulfate, potassium persulfate, and 2,2'-azobis(2-amidinopropane)hydrochloride are preferable. In addition, a method of adding a polymerization initiator is not particularly limited, and batch addition, divided addition, continuous dropping or the like can be appropriately selected. In addition, the content of the polymerization initiator is not particularly limited, and is generally about 0.001 to 5 parts by weight, and preferably about 0.01 to 1 parts by weight with respect to 100 parts by weight of the components (a2) to (a7).

Regarding polymerization conditions, for example, the reaction temperature is generally 60 to 95° C. (preferably 70 to 90° C.). In addition, the reaction time is, for example, generally 1 to 6 hours (preferably 2 to 4 hours).

Here, the obtained (meth)acrylamide polymer may contain an unreacted component (a1).

The weight average molecular weight of the (meth) acrylamide polymer is preferably 1,500,000 to 7,000,000, more preferably 1,600,000 to 6,500,000, and still more preferably 1,800,000 to 6,000,000 because the papermaking agent exhibits excellent storage stability, and when the papermaking agent is added to a pulp slurry, the pulp is appropriately aggregated due to the (meth)acrylamide polymer contained in the agent, the polymer is fixed to pulp fibers and an excellent paper strength effect is exhibited.

Here, the weight average molecular weight is a value obtained by a gel permeation chromatography (GPC) method.

The viscosity of the (meth)acrylamide polymer measured by a B-type viscometer at a temperature of 25° C. is preferably 3,000 to 18,000 mPa·s, more preferably 3,500 to 15,000 mPa·s, and still more preferably 4,000 to 13,000 mPa·s because the papermaking agent exhibits excellent storage stability, and when the papermaking agent is added to a pulp slurry, the pulp is appropriately aggregated due to the (meth)acrylamide polymer contained in the agent, the polymer is fixed to pulp fibers and an excellent paper strength effect is exhibited.

The (meth)acrylamide polymer has a maximum value of 50 to 1,000 NTU of the turbidity at a pH of 3 to 9 in an aqueous solution containing the component (A) having a concentration of 1 weight % dissolved in water prepared from deionized water and sodium sulfate and having an electrical conductivity of 3 mS/cm at 25° C. This numerical value means that, when the papermaking agent is dissolved in a sodium sulfate aqueous solution having an electrical conductivity of 3 mS/cm at 25° C. to prepare an aqueous solution containing the (meth)acrylamide copolymer having a concentration of 1 weight %, the maximum value of the turbidity of the aqueous solution at a pH of 3 to 9 is 50 to 1,000 NTU. If the turbidity satisfies the above numerical value, when the papermaking agent is added to a pulp slurry, the pulp is appropriately aggregated and an excellent paper strength effect is exhibited. In addition, from the same point of view, the turbidity is preferably 60 to 800 NTU and more preferably 80 to 600 NTU.

The turbidity is the degree of turbidity, and is a value obtained by measuring 180-degree scattered light using 900 nm infrared light using ANALITE NEPHELOMETER 152 (commercially available from Mc Van Instruments). The measured value is a relative evaluation value with respect to a standard substance (formazin standard solution 400 NTU, commercially available from Wako Pure Chemical Industries, Ltd.).

Water (aqueous solution) used for turbidity measurement is a sodium sulfate aqueous solution having an electrical conductivity of 3 mS/cm at 25° C. Water used for preparing a sodium sulfate aqueous solution is preferably deionized water. This deionized water is water that has been passed through an ion exchange resin and has an electrical conductivity of 0.2 mS/cm or less. The reason why the above sodium sulfate aqueous solution is used is that, since white water during papermaking contains a large amount of sulfate ions and sodium ions, when sodium sulfate is used, it is possible to create an environment similar to the environment during papermaking, and it is possible to easily increase the electrical conductivity.

Figure 2:
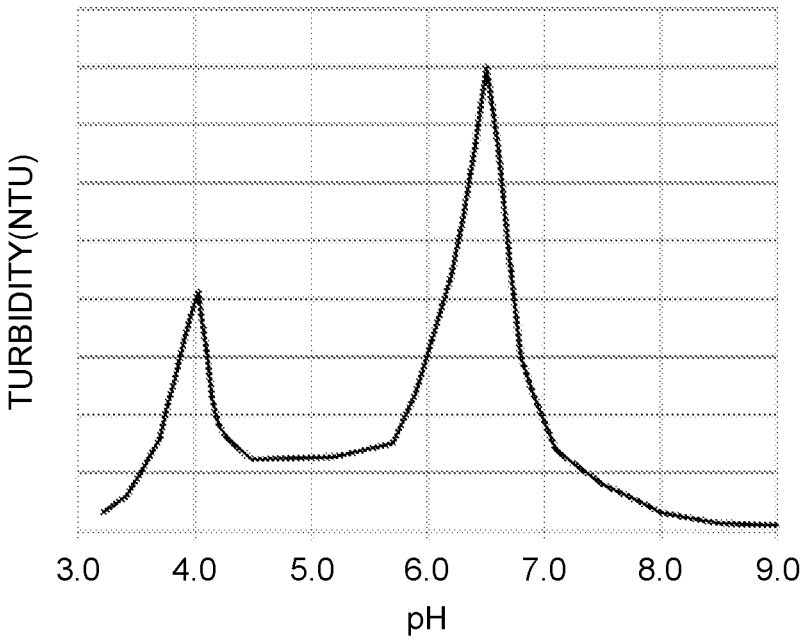
FIG. 2 is a diagram showing a case in which there are "two peaks" in the pH-turbidity distribution.

The turbidity correlates with the degree to which the (meth)acrylamide polymer forms a polyion complex (PIC) and its value varies depending on the pH. Since the (meth) acrylamide polymer has anionic and cationic functional groups in the molecule, it forms a PIC when the pH of the solution approaches the vicinity of the isoelectric point. When the (meth)acrylamide polymer starts to form a PIC, the solution becomes turbid. FIG. 1 is a diagram showing a case in which there is "one peak" in the turbidity distribution. In the turbidity distribution, as shown in FIG. 1, when the pH gradually increases, the turbidity of the solution becomes gradually thicker at first, and the value of the turbidity continues to increase. Thus, after the value reaches the maximum value, the turbidity becomes thinner and the value of the turbidity also decreases (this distribution is called "one peak," refer to FIG. 1). In addition, when an excessive amount of PIC is formed, since the turbidity is thinner due to the formation of precipitates in the solution at a certain point, the value of the turbidity decreases, and when the pH further increases, the turbidity becomes thicken again due to gradual appearance of the precipitate, and the value of the turbidity increases. FIG. 2 is a diagram showing a case in which there are "two peaks" in the turbidity distribution. In this case, as shown in FIG. 2, the turbidity distribution when the pH is changed from 3 to 9, it has two peaks (this distribution is called "two peaks," refer to FIG. 2). In the present invention, in the case of two peaks, if any one peak has a maximum value of 50 to 1,000 NTU, an excellent paper strength effect is exhibited.

The paper of the present invention contains the above papermaking agent, and for example, the manufacturing method includes addition of a papermaking agent to a raw pulp slurry (hereinafter also referred to as internal addition), spraying it onto the surface of wet paper, or applying it to the surface of the base paper. Here, the papermaking agent is preferably diluted with water and is adjusted so that the non-volatile content concentration is 0.1 to 2 weight %.

In the case of internal addition to a raw pulp slurry, the papermaking agent is added to a pulp slurry to make paper. The amount of the papermaking agent used (in terms of the non-volatile content of the component (A)) is not particularly limited, and is about 0.01 to 4 weight % with respect to the dry weight of the pulp. In addition, the type of the pulp is not particularly limited, and examples thereof include chemical pulp such as hardwood pulp (LBKP) and softwood pulp (NBKP); mechanical pulp such as ground pulp (GP), refiner ground pulp (RGP), and thermomechanical pulp (TMP); and recycled pulp such as waste corrugated fiberboard. Here, when the papermaking agent is internally added, additionally, as fixing agents, pH adjusting agents such as aluminum sulfate, sulfuric acid and sodium hydroxide; papermaking chemicals such as a sizing agent and a wet paper strengthening agent; and fillers such as talc, clay, kaolin, titanium dioxide, and calcium carbonate can be added.

In the case of spraying onto the surface of wet paper, the papermaking agent is sprayed onto the surfaces of one or more layers of wet paper before they are combined and combining is then performed. In this case, the papermaking agent that is diluted so that the concentration is about 0.1 to 7 weight % is used. In addition, the viscosity after dilution is about 2 to 50 mPa·s (a concentration of 1.0 weight %, 25° C.) at a temperature of 25° C., and the used amount thereof (in terms of the non-volatile content) is generally 0.05 to 10 weight % with respect to the total pulp (non-volatile content weight).

In the case of application to the surface of base paper, the papermaking agent is applied to the surface of base paper by various known methods. Here, the papermaking agent applied to the surface of the base paper is referred to as a "coating liquid." The viscosity of the coating liquid is generally 1 to 40 mPa·s at a temperature of 50° C. Regarding the type of base paper, uncoated paper made from wood cellulose fibers as a raw material can be used, and the application method is not particularly limited, and examples thereof include methods using a bar coater, a knife coater, an air knife coater, a calender, a gate roll coater, a blade coater, a 2-roll size press, rod metering and the like. In addition, the coating amount of the coating liquid (in terms of the non-volatile content) is not particularly limited, and is generally about 0.001 to 2 g/m$^2$, and preferably about 0.005 to 1 g/m$^2$.

The paper of the present invention is used for various products, and examples thereof include coated base paper, newsprint paper, liner, core, paper tube, printing and writing paper, foam paper, PPC paper, cup base paper, inkjet paper, and thermal paper.

EXAMPLES

Hereinafter, the present invention will be described with reference to examples, but the present invention is not limited thereto. Unless otherwise specified, "parts" and "%" in examples and comparative examples are based on weight.

The following compounds are abbreviated.

AM: acrylamide

DM: N,N-dimethylaminoethyl methacrylate

DML: N,N-dimethylaminoethyl methacrylate benzyl chloride

IA: itaconic acid

SMAS: sodium methallyl sulfonate

DMAA: N,N-dimethylacrylamide

APS: ammonium persulfate

<Viscosity>

1. Component (a1)

Deionized water was added so that the non-volatile content concentration of starches (a1) used as the raw material was 20% and the mixture was then stirred at 90° C. for 1 hour to obtain a gelatinization liquid. The viscosity of the gelatinization liquid adjusted to a temperature of 25° C. was measured using a B-type viscometer (commercially available from Toki Sangyo Co., Ltd.).

2. (Meth)Acrylamide Polymer

The viscosity of the (meth)acrylamide polymer (A) adjusted to a temperature of 25° C. was measured using a B-type viscometer (commercially available from Toki Sangyo Co., Ltd.).

<Weight Average Molecular Weight>

The weight average molecular weight of the (meth) acrylamide polymer (A) was measured by a gel permeation chromatography (GPC) method under the following measurement conditions.

Column: one guard column PWXL and two GMPWXL columns (commercially available from Tosoh Corporation)

Eluent: phosphate buffer solution (0.05 mol/L phosphate (commercially available from FUJIFILM Wako Pure Chemical Corporation)+0.13 mol/L sodium dihydrogen phosphate (commercially available from FUJIFILM Wako Pure Chemical Corporation) aqueous solution, a pH of about 2.5)

Flow rate: 0.8 ml/min

Temperature: 40° C.

RI detector: Shodex RI-101 (commercially available from Showa Denko K.K.)

MALS detector: DAWN HELEOS-II (commercially available from WYATT)

Measurement sample: dilution with the eluent was performed so that the non-volatile content concentration of the (meth)acrylamide polymer (A) was 0.1%, and measurement was performed.

<Turbidity>

Turbidity meter: ANALITE NEPHELOMETER 152 (commercially available from McVan Instruments)

Infrared wavelength: 900 nm

Standard substance: formazin standard solution (400 NTU, commercially available from Wako Pure Chemical Industries, Ltd.)

Sample concentration: 1% (non-volatile content concentration of the (meth)acrylamide polymer (A))

Solvent: water prepared from deionized water and sodium sulfate and having an electrical conductivity of 3 mS/cm at 25° C.

Sample temperature: 25° C.

(Measurement Method)

An aqueous solution obtained by diluting the (meth) acrylamide polymer (A) in the above solvent to a non-volatile content concentration of 1% was stirred with a stirrer at 500 rpm. A 1% sodium hydroxide aqueous solution was used to increase the pH, a 1% sulfuric acid aqueous solution was used to decrease the pH, and these solutions were gradually added dropwise so that the pH changed by 0.1, and the value of the turbidity with respect to the pH was measured. When the turbidity value was not stable, waiting was performed until it became stable, and the numerical value when it became stable was used as the turbidity value. In the turbidity distribution (peak) obtained by the measurement, the maximum value was read. Here, when there were two peaks in the turbidity distribution (peak), a higher value was used as the maximum value. Table 1 shows the maximum value of the turbidity.

Manufacturing Example 1 (Manufacture of Enzyme Modified Cationic Starch)

100 parts (non-volatile content) of cationic starch (product name: "CS-2," commercially available from Arakawa Chemical Industries, Ltd.), 0.02 parts of α-amylase (product name: "Kleistase L1," commercially available from Amano Enzyme Inc.), and 36.6 parts of deionized water were put into a reaction device including a stirrer, a thermometer, a reflux cooling pipe, a dropping funnel, and a nitrogen gas introduction pipe, and the mixture was heated to 75° C. and stirred for 40 minutes and then heated to 90° C. and additionally stirred for 1 hour to obtain an enzyme modified cationic starch having a non-volatile content concentration of 20% and a viscosity of 120 mPa·s (25° C.).

Manufacturing Example 2 (Manufacture of Enzyme Modified Amphoteric Starch)

100 parts (non-volatile content) of an amphoteric starch having a phosphate ester group (product name: "Cato3210," commercially available from Ingredion Japan K.K.), 0.02 parts of α-amylase (product name: "Kleistase L1," commercially available from Amano Enzyme Inc.), and 400 parts of deionized water were put into the same reaction device as in Manufacturing Example 1, and the mixture was heated to 75° C. and stirred for 40 minutes and then heated to 90° C. and additionally stirred for 1 hour to obtain an enzyme modified amphoteric starch having a non-volatile content concentration of 20% and a viscosity of 1,100 mPa·s (25° C.). Here, the enzyme modified amphoteric starch belongs to starches having a phosphate ester group.

Example 1

50 parts (non-volatile content) of a urea-phosphate-esterified starch (product name: "Ace P160," commercially available from Oji Cornstarch Co., Ltd.) 50 parts (non-volatile content) of an oxidized starch (product name: "Ace A," commercially available from Oji Cornstarch Co., Ltd.) and 400 parts of deionized water were put into a reaction device including a stirrer, a thermometer, a reflux cooling pipe, a dropping funnel, and a nitrogen gas introduction pipe, nitrogen gas was directly blown thereinto, oxygen in the liquid was removed and stirring was then performed while the temperature was raised to 80° C. 644 parts (non-volatile content: 322 parts) of a 50% AM aqueous solution, 40 parts of DM, 33.3 parts (non-volatile content 20 parts) of 60% DML, 12 parts of IA, 6 parts of SMAS, 19.6 parts (non-volatile content: 12.3 parts) of a 62.5% sulfuric acid aqueous solution and 245.1 parts of deionized water were put into a dropping funnel (1), the pH was adjusted to 3.0 with sulfuric acid. In addition, 0.8 parts of APS and 180 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 2 was reached. The sample was diluted with deionized water so that the non-volatile content concentration was 25% to obtain a (meth)acrylamide polymer (A-1). Table 2 shows the viscosity (this value was defined as X), the weight average molecular weight and the maximum value of the turbidity (the same applies hereinafter).

Examples 2 to 6, and 12 to 24 and Comparative Examples 1 and 2

Using the compositions and used amounts shown in Table 2, the same method as in Example 1 was performed to obtain (meth)acrylamide polymers (A-2) to (A-6), (A-12) to (A-24), and (B-1) to (B-2).

Example 7

75 parts (non-volatile content) of a urea-phosphate-esterified starch (product name: "Ace P160," commercially available from Oji Cornstarch Co., Ltd.), 75 parts (non-volatile content) of an oxidized starch (product name: "Ace A," commercially available from Oji Cornstarch Co., Ltd.) and 586 parts of deionized water were put into the same reaction device as in Example 1, nitrogen gas was directly blown thereinto, oxygen in the liquid was removed and stirring was then performed while the temperature was raised to 800c. 563.4 parts (non-volatile content: 281.7 parts) of a 50% AM aqueous solution, 35 parts of DM, 29.2 parts (non-volatile content: 17.5 parts) of 60% DML, 10.5 parts of IA, 5.3 parts of SMAS, 17.1 parts (non-volatile content: 10.7 parts) of a 62.5% sulfuric acid aqueous solution and 183.8 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 2 was reached. The sample was diluted with deionized water so that the non-volatile content concentration was 25% to obtain a (meth)acrylamide polymer (A-7).

Example 8

100 parts (non-volatile content) of a urea-phosphate-esterified starch (product name: "Ace P160," commercially available from Oji Cornstarch Co., Ltd.), 100 parts (non-volatile content) of an oxidized starch (product name: "Ace A," commercially available from Oji Cornstarch Co., Ltd.) and 689.4 parts of deionized water were put into the same reaction device as in Example 1, nitrogen gas was directly blown thereinto, oxygen in the liquid was removed and stirring was then performed while the temperature was raised to 80° C. 483 parts (non-volatile content: 241.5 parts) of a 50% AM aqueous solution, 30 parts of DM, 25 parts (non-volatile content: 15 parts) of 60% DML, 9 parts of IA, 4.5 parts of SMAS, 14.7 parts (non-volatile content: 9.2 parts) of a 62.5% sulfuric acid aqueous solution and 183.8 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 2 was reached. The sample was diluted with deionized water so that the non-volatile content concentration was 25% to obtain a (meth)acrylamide polymer (A-8).

Example 9

125 parts (non-volatile content) of a urea-phosphate-esterified starch (product name: "Ace P160," commercially available from Oji Cornstarch Co., Ltd.), 125 parts (non-volatile content) of an oxidized starch (product name: "Ace A," commercially available from Oji Cornstarch Co., Ltd.) and 877 parts of deionized water were put into the same reaction device as in Example 1, nitrogen gas was directly blown thereinto, oxygen in the liquid was removed and stirring was then performed while the temperature was raised to 80° C. 402.4 parts (non-volatile content: 201.2 parts) of a 50% AM aqueous solution, 25 parts of DM, 20.8 parts (non-volatile content 12.5 parts) of 60% DML, 7.5 parts of IA, 3.8 parts of SMAS, 12.2 parts (non-volatile content: 7.6 parts) of a 62.5% sulfuric acid aqueous solution and 153.2 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 2 was reached. The sample was diluted with deionized water so that the non-volatile content concentration was 25% to obtain a (meth)acrylamide polymer (A-9).

Example 10

50 parts (non-volatile content) of a urea-phosphate-esterified starch (product name: "Ace P160," commercially available from Oji Cornstarch Co., Ltd.), 250 parts (non-volatile content: 50 parts) of the enzyme modified cationic starch of Manufacturing Example 1 and 200 parts of deionized water were put into the same reaction device as in Example 1, nitrogen gas was directly blown thereinto, oxygen in the liquid was removed and stirring was then performed while the temperature was raised to 80° C. Then, the process was performed in the same manner as in Example 1 to obtain a (meth)acrylamide polymer (A-10) having a non-volatile content concentration of 25.0%.

Example 11

250 parts (non-volatile content: 50 parts) of the enzyme modified cationic starch of Manufacturing Example 1, 250 parts (non-volatile content: 50 parts) of the enzyme modified amphoteric starch of Manufacturing Example 2 and 10 parts of deionized water were put into the same reaction device as in Example 1, nitrogen gas was directly blown thereinto, oxygen in the liquid was removed and stirring was then performed while the temperature was raised to 80° C. Then, the process was performed in the same manner as in Example 1 to obtain a (meth)acrylamide polymer (A-11) having a non-volatile content concentration of 25.0%.

Example 25

50 parts (non-volatile content) of a urea-phosphate-esterified starch (product name: "Ace P160," commercially available from Oji Cornstarch Co., Ltd.), 50 parts (non-volatile content) of an oxidized starch (product name: "Ace A," commercially available from Oji Cornstarch Co., Ltd.) and 367.8 parts of deionized water were put into the same reaction device as in Example 1, nitrogen gas was directly blown thereinto, oxygen in the liquid was removed and stirring was then performed while the temperature was raised to 80° C. 632.0 parts (non-volatile content: 316 parts) of a 50% AM aqueous solution, 40 parts of DM, 33.3 parts (non-volatile content 20 parts) of 60% DML, 12 parts of IA, 12 parts of SMAS, 19.6 parts (non-volatile content: 12.3 parts) of a 62.5% sulfuric acid aqueous solution and 251.1 parts of deionized water were put into a dropping funnel (1), and the pH was adjusted to 3.0 with sulfuric acid. In addition, 0.8 parts of APS and 60 parts of deionized water were put into a dropping funnel (2). Next, dropwise addition was performed into the starch aqueous solution over 3 hours from the dropping funnels (1) and (2). After dropwise addition was completed, 0.8 parts of APS and 10 parts of deionized water were added and reacted until the viscosity shown in Table 2 was reached. The sample was diluted with deionized water so that the non-volatile content concentration was 32% to obtain a (meth)acrylamide polymer (A-25).

Comparative Example 3

500 parts (non-volatile content: 100 parts) of the enzyme modified amphoteric starch of Manufacturing Example 2 and 10 parts of deionized water were put into the same reaction device as in Example 1, nitrogen gas was directly blown thereinto, oxygen in the liquid was removed and stirring was then performed while the temperature was raised to 80° C. Then, the process was performed in the same manner as in Example 1 to obtain a (meth)acrylamide polymer (B-3) having a non-volatile content concentration of 25.0%.

The (meth)acrylamide polymers of the examples and the comparative examples were used papermaking agents without change.

<Storage Stability>

Each papermaking agent was left in a thermostat at 5° C. (a condition in which starch aging easily occurred) for one month. The viscosity of each papermaking agent after the temperature was adjusted to 25° C. was measured, and the value was defined as Y (mPa.s), and Y/X was calculated. The results are shown in Table 2. A smaller value of Y/X indicates better storage stability, and the value is preferably 1 to 2 and more preferably 1 to 1.7.

TABLE 2

| | (Meth)acrylamide polymer Composition | | | | | | | | | | |
|---|---|---|---|---|---|---|---|---|---|---|---|
| | Starches (non-volatile content weight ratio) | | | Monomer (weight %) | | | | | | | Starches/monomers (weight ratio) |
| | | | | AM | DM | DML | IA | AA | SMAS | DMAA | |
| Example 1 | Urea-phosphate-esterified starch | Oxidized starch | 5/5 | 80.5 | 10.0 | 5.0 | 3.0 | — | 1.5 | — | 2/8 |
| Example 2 | Urea-phosphate-esterified starch | Oxidized starch | 2/8 | 80.5 | 10.0 | 5.0 | 3.0 | — | 1.5 | — | 2/8 |
| Example 3 | Urea-phosphate-esterified starch | Oxidized starch | 8/2 | 80.5 | 10.0 | 5.0 | 3.0 | — | 1.5 | — | 2/8 |
| Example 4 | Urea-phosphate-esterified starch | Oxidized starch | 9/1 | 80.5 | 10.0 | 5.0 | 3.0 | — | 1.5 | — | 2/8 |
| Example 5 | Urea-phosphate-esterified starch | Oxidized starch | 1/9 | 80.5 | 10.0 | 5.0 | 3.0 | — | 1.5 | — | 2/8 |
| Example 6 | Urea-phosphate-esterified starch | Oxidized starch | 5/5 | 80.5 | 10.0 | 5.0 | 3.0 | — | 1.5 | — | 1/9 |
| Example 7 | Urea-phosphate-esterified starch | Oxidized starch | 5/5 | 80.5 | 10.0 | 5.0 | 3.0 | — | 1.5 | — | 3/7 |
| Example 8 | Urea-phosphate-esterified starch | Oxidized starch | 5/5 | 80.5 | 10.0 | 5.0 | 3.0 | — | 1.5 | — | 4/6 |

TABLE 2-continued

| | | | | | | | | | | | |
|---|---|---|---|---|---|---|---|---|---|---|---|
| Example 9 | Urea-phosphate-esterified starch | Oxidized starch | 5/5 | 80.5 | 10.0 | 5.0 | 3.0 | — | 1.5 | — | 5/5 |
| Example 10 | Urea-phosphate-esterified starch | Enzyme modified Cationic starch | 5/5 | 80.5 | 10.0 | 5.0 | 3.0 | — | 1.5 | — | 2/8 |
| Example 11 | Enzyme modified amphoteric starch | Enzyme modified Cationic starch | 5/5 | 80.5 | 10.0 | 5.0 | 3.0 | — | 1.5 | — | 2/8 |
| Example 12 | Urea-phosphate-esterified starch | Oxidized starch | 5/5 | 81.2 | 10.0 | 5.0 | 3.0 | — | 0.8 | — | 2/8 |
| Example 13 | Urea-phosphate-esterified starch | Oxidized starch | 5/5 | 78.0 | 10.0 | 5.0 | 3.0 | — | 4.0 | — | 2/8 |
| Example 14 | Urea-phosphate-esterified starch | Oxidized starch | 5/5 | 74.5 | 10.0 | 5.0 | 3.0 | — | 6.0 | 1.5 | 2/8 |
| Example 15 | Urea-phosphate-esterified starch | Oxidized starch | 5/5 | 80.0 | 10.0 | 5.0 | 3.0 | — | 1.5 | 0.5 | 2/8 |
| Example 16 | Urea-phosphate-esterified starch | Oxidized starch | 5/5 | 77.5 | 10.0 | 5.0 | | 6.0 | 1.5 | — | 2/8 |
| Example 17 | Urea-phosphate-esterified starch | Oxidized starch | 5/5 | 70.5 | 20.0 | 5.0 | 3.0 | — | 1.5 | — | 2/8 |
| Example 18 | Urea-phosphate-esterified starch | Oxidized starch | 5/5 | 75.5 | 5.0 | 15.0 | 3.0 | — | 1.5 | — | 2/8 |
| Example 19 | Urea-phosphate-esterified starch | Oxidized starch | 5/5 | 73.5 | 10.0 | 5.0 | 10.0 | — | 1.5 | — | 2/8 |
| Example 20 | Urea-phosphate-esterified starch | Oxidized starch | 5/5 | 64.0 | 20.0 | 5.0 | 10.0 | — | 1.0 | — | 2/8 |
| Example 21 | Urea-phosphate-esterified starch | Oxidized starch | 5/5 | 50.3 | 25.0 | 10.0 | 14.0 | — | 0.7 | — | 2/8 |
| Example 22 | Urea-phosphate-esterified starch | Oxidized starch | 5/5 | 92.5 | 3.0 | 1.0 | 1.5 | — | 2.0 | — | 2/8 |
| Example 23 | Urea-phosphate-esterified starch | Oxidized starch | 5/5 | 96.3 | 0.5 | 0.5 | 0.5 | — | 2.2 | — | 2/8 |
| Example 24 | Urea-phosphate-esterified starch | Oxidized starch | 5/5 | 81.0 | 10.0 | 5.0 | 3.0 | — | 1.0 | — | 2/8 |
| Example 25 | Urea-phosphate-esterified starch | Oxidized starch | 5/5 | 79.0 | 10.0 | 5.0 | 3.0 | — | 3.0 | — | 2/8 |
| Comparative Example 1 | Oxidized starch | — | 10/0 | 80.5 | 10.0 | 5.0 | 3.0 | — | 1.5 | — | 2/8 |
| Comparative Example 2 | Urea-phosphate-esterified starch | — | 10/0 | 80.5 | 10.0 | 5.0 | 3.0 | — | 1.5 | — | 2/8 |
| Comparative Example 3 | Enzyme modified amphoteric starch | — | 10/0 | 80.5 | 10.0 | 5.0 | 3.0 | — | 1.5 | — | 2/8 |

TABLE 2-continued

| | (Meth)acrylamide polymer Physical properties | | | | | | |
|---|---|---|---|---|---|---|---|
| | | | Viscosity (mPa · s) | | | Weight | |
| | Number | Concentration (%) | X immediately after manufacturing | Y after storage at 5° C. for 1 month | Y/X | average molecular weight (10,000) | Maximum value of turbidity (NTU) |
| Example 1 | A-1 | 25 | 8800 | 11400 | 1.30 | 280 | 160 |
| Example 2 | A-2 | 25 | 9200 | 12800 | 1.39 | 260 | 140 |
| Example 3 | A-3 | 25 | 9500 | 11900 | 1.25 | 330 | 180 |
| Example 4 | A-4 | 25 | 8500 | 12100 | 1.42 | 350 | 200 |
| Example 5 | A-5 | 25 | 8600 | 12800 | 1.49 | 270 | 130 |
| Example 6 | A-6 | 25 | 8800 | 10600 | 1.20 | 340 | 110 |
| Example 7 | A-7 | 25 | 9000 | 12300 | 1.37 | 230 | 180 |
| Example 8 | A-8 | 25 | 9100 | 13450 | 1.48 | 190 | 200 |
| Example 9 | A-9 | 25 | 8700 | 17100 | 1.97 | 130 | 210 |
| Example 10 | A-10 | 25 | 8400 | 10300 | 1.23 | 310 | 150 |
| Example 11 | A-11 | 25 | 9600 | 12250 | 1.28 | 360 | 200 |
| Example 12 | A-12 | 25 | 9200 | 11900 | 1.29 | 220 | 140 |
| Example 13 | A-13 | 25 | 8500 | 11800 | 1.39 | 490 | 190 |
| Example 14 | A-14 | 25 | 8300 | 12100 | 1.46 | 610 | 220 |
| Example 15 | A-15 | 25 | 9100 | 12600 | 1.38 | 320 | 170 |
| Example 16 | A-16 | 25 | 9000 | 11400 | 1.27 | 320 | 120 |
| Example 17 | A-17 | 25 | 9000 | 11200 | 1.24 | 260 | 480 |
| Example 18 | A-18 | 25 | 9300 | 10850 | 1.17 | 270 | 440 |
| Example 19 | A-19 | 25 | 8200 | 10900 | 1.33 | 260 | 310 |
| Example 20 | A-20 | 25 | 8900 | 10700 | 1.20 | 240 | 400 |
| Example 21 | A-21 | 25 | 9400 | 10550 | 1.12 | 170 | 920 |
| Example 22 | A-22 | 25 | 9100 | 12650 | 1.39 | 330 | 80 |
| Example 23 | A-23 | 25 | 8700 | 12100 | 1.39 | 360 | 50 |
| Example 24 | A-24 | 20 | 8100 | 9180 | 1.13 | 310 | 190 |
| Example 25 | A-25 | 32 | 9000 | 13200 | 1.47 | 320 | 160 |
| Comparative Example 1 | B-1 | 25 | 8800 | 46900 | 5.33 | 260 | 120 |
| Comparative Example 2 | B-2 | 25 | 9200 | 26600 | 2.89 | 360 | 210 |
| Comparative Example 3 | B-3 | 25 | 9400 | 25100 | 2.67 | 320 | 180 |

Component (a1) (*the viscosity is a value obtained by measuring starches gelatinized under the above conditions)

Urea-phosphate-esterified starch-product name: "Ace P160," commercially available from Oji Cornstarch Co., Ltd., a viscosity of 40 mPa·s (a non-volatile content concentration of 20% and a temperature of 25° C.)

Oxidized starch-product name: "Ace A," commercially available from Oji Cornstarch Co., Ltd., a viscosity of 400 mPa·s (a non-volatile content concentration of 20% and a temperature of 25° C.)

Enzyme modified cationic starch—refer to Manufacturing Example 1.

Enzyme modified amphoteric starch—refer to Manufacturing Example 2.

<Papermaking Evaluation>

Evaluation Examples 1 to 25 and Comparative Evaluation Examples 1 to 3

Using the papermaking agent of each example after the storage stability test (after storage at 5° C. for 1 month), deionized water was added and the sample was diluted so that the non-volatile content concentration was 1.0%. Then, the following papermaking evaluation was performed. Here, the papermaking agents of Comparative Examples 1 to 3 were not evaluated because they had poor storage stability.

Corrugated cardboard waste paper was beaten with a Niagara beater, calcium chloride was added to a pulp slurry adjusted to 350 ml of Canadian standard freeness (C. S. F), and the electrical conductivity was adjusted to 3.0 mS/cm. After 0.5% of the non-volatile content of aluminum sulfate with respect to the non-volatile content weight of the pulp slurry was added to this slurry liquid, each papermaking agent was added in an amount at which the non-volatile content was 0.5% with respect to the non-volatile content weight of the pulp slurry. The pH of each pulp slurry was adjusted to 6.5. The sample was dehydrated with a tappi sheet machine and pressed at 5 kg/cm$^2$ for 2 minutes to make paper so that the basis weight was 150 g/m$^2$. Next, the sample was dried with a rotary dryer at 105° C. for 4 minutes, and the humidity was controlled for 24 hours under conditions of a temperature of 23° C. and a humidity of 50% to obtain Paper 1. Here, papermaking was performed in the same method without adding the papermaking agent to obtain Paper 2. The amount of drainage, formation, burst strength and fixation rate of Paper 1 were measured by the following methods. The results are shown in Table 3.

<Amount of Drainage>

The amount of drainage was measured using Canadian standard freeness (C. S. F) according to JIS P 8121.

<Formation (Formation Variation Coefficient)>

Light (luminance) passing through the paper obtained above was incorporated into a commercially available measuring instrument (product name "Personal Image Processing System Hyper-700," commercially available from OBS), and the value obtained by statistically analyzing the luminance distribution was defined as a formation variation coefficient. A smaller value of the formation variation coefficient indicates better formation.

<Specific Burst Strength>

The specific burst strength (kPa·m$^2$/g) was measured using the paper obtained above according to JIS P 8131.

TABLE 3

| | Symbol | Drainage (mL) | Formation variation coefficient (%) | Specific burst strength (kPa · m$^2$/g) |
|---|---|---|---|---|
| Evaluation Example 1 | A-1 | 458 | 26.7 | 3.52 |
| Evaluation Example 2 | A-2 | 446 | 26.0 | 3.47 |
| Evaluation Example 3 | A-3 | 474 | 27.7 | 3.55 |
| Evaluation Example 4 | A-4 | 484 | 28.2 | 3.56 |
| Evaluation Example 5 | A-5 | 444 | 25.9 | 3.46 |
| Evaluation Example 6 | A-6 | 447 | 26.1 | 3.48 |
| Evaluation Example 7 | A-7 | 453 | 26.4 | 3.50 |
| Evaluation Example 8 | A-8 | 448 | 26.2 | 3.48 |
| Evaluation Example 9 | A-9 | 406 | 23.7 | 3.26 |
| Evaluation Example 10 | A-10 | 460 | 26.8 | 3.52 |
| Evaluation Example 11 | A-11 | 486 | 28.3 | 3.57 |
| Evaluation Example 12 | A-12 | 437 | 25.5 | 3.43 |
| Evaluation Example 13 | A-13 | 502 | 29.3 | 3.58 |
| Evaluation Example 14 | A-14 | 525 | 30.6 | 3.56 |
| Evaluation Example 15 | A-15 | 469 | 27.4 | 3.56 |
| Evaluation Example 16 | A-16 | 449 | 26.2 | 3.48 |
| Evaluation Example 17 | A-17 | 520 | 30.3 | 3.55 |
| Evaluation Example 18 | A-18 | 517 | 30.2 | 3.54 |
| Evaluation Example 19 | A-19 | 493 | 28.7 | 3.55 |
| Evaluation Example 20 | A-20 | 503 | 29.4 | 3.49 |
| Evaluation Example 21 | A-21 | 535 | 31.2 | 3.40 |
| Evaluation Example 22 | A-22 | 428 | 25.0 | 3.40 |
| Evaluation Example 23 | A-23 | 408 | 23.8 | 3.27 |
| Evaluation Example 24 | A-24 | 474 | 27.6 | 3.58 |
| Evaluation Example 25 | A-25 | 465 | 27.1 | 3.54 |
| Comparative Evaluation Example 1 | B-1 | | not evaluated | |
| Comparative Evaluation Example 2 | B-2 | | | |
| Comparative Evaluation Example 3 | B-3 | | | |

What is claimed is:

1. A papermaking agent comprising a (meth)acrylamide polymer containing two or more starches (a1) selected from the group consisting of unmodified starch, oxidized starch, esterified starch, etherified starch, amidated starch, cationic starch, amphoteric starch and crosslinked starch, a (meth) acrylamide (a2), a polymerizable monomer having an amino group (a3), a polymerizable monomer having a carboxy group (a4) and a polymerizable monomer having a sulfonate group (a5) as essential constituent components.

2. The papermaking agent according to claim 1, wherein the component (a1) includes one type of starches (a1-1) selected from the group consisting of esterified starch and amphoteric starch and one type of starches (a1-2) selected from the group consisting of unmodified starch, oxidized starch and cationic starch.

3. The papermaking agent according to claim 1, wherein a ratio between an amount of the component (a1) used in terms of non-volatile content weight and a total amount of the components (a2) to (a5) used is [(a1)/{(a2)+(a3)+(a4)+(a5)}]=5/95 to 45/55.

4. The papermaking agent according to claim 1, wherein, when the total amount of the components (a2) to (a5) used is set as 100 weight %, an amount of the component (a3) is 1.5 to 35 weight %, an amount of the component (a4) is 1 to 15 weight %, and an amount of the component (a5) is 0.5 to 8 weight %.

5. The papermaking agent according to claim 1, wherein the constituent component further includes a polymerizable monomer having a crosslinkable group (a6).

6. The papermaking agent according to claim 1, wherein a weight average molecular weight of the (meth) acrylamide polymer is 1,500,000 to 7,000,000.

7. The papermaking agent according to claim 1, wherein a maximum value of a turbidity of an aqueous solution containing 1 weight % of the (meth)acrylamide polymer at a pH of 3 to 9 diluted with water prepared from deionized water and sodium sulfate and having an electrical conductivity of 3 mS/cm at 25° C. is 50 to 1,000 NTU.

8. A method for manufacturing the papermaking agent according to claim 1, comprising a process of obtaining a (meth)acrylamide polymer by polymerizing the component (a1), the component (a2), the component (a3), the component (a4) and the component (a5) as essential constituent components in the presence of the component (a1).

9. The method for manufacturing the papermaking agent according to claim 8, wherein the constituent component further includes a polymerizable monomer having a crosslinkable group (a6).

10. Paper comprising the papermaking agent according to claim 1.

* * * * *